US008997540B2

(12) United States Patent
Shen

(10) Patent No.: US 8,997,540 B2
(45) Date of Patent: Apr. 7, 2015

(54) TAIL END RING CONTROL IN A CURVED GUIDE OF A COILER

(75) Inventor: William Xiaolan Shen, Boylston, MA (US)

(73) Assignee: Primetals Technologies USA LLC, Worcester, MA (US)

( * ) Notice: Subject to any disclaimer, the term of this patent is extended or adjusted under 35 U.S.C. 154(b) by 424 days.

(21) Appl. No.: 13/470,470

(22) Filed: May 14, 2012

(65) Prior Publication Data

US 2013/0075521 A1 Mar. 28, 2013

Related U.S. Application Data

(60) Provisional application No. 61/539,696, filed on Sep. 27, 2011.

(51) Int. Cl.

| | |
|---|---|
| ***B21D 11/00*** | (2006.01) |
| ***B21F 3/02*** | (2006.01) |
| ***B21B 41/02*** | (2006.01) |
| ***B21B 39/20*** | (2006.01) |
| ***B21C 47/14*** | (2006.01) |
| ***B21C 49/00*** | (2006.01) |

(52) U.S. Cl.
CPC ..... *B21C 47/143* (2013.01); *B21C 49/00* (2013.01)

(58) Field of Classification Search
CPC ..... B21F 3/04; B21C 47/14; B21C 47/146; B21C 47/143
USPC ..... 72/66, 135, 142, 230, 231, 228, 250; 242/361–361.5
See application file for complete search history.

(56) References Cited

U.S. PATENT DOCUMENTS

| | | | | |
|---|---|---|---|---|
| 6,149,091 | A * | 11/2000 | Poloni et al. | 242/361.4 |
| 6,345,780 | B1 * | 2/2002 | Poloni et al. | 242/361.3 |
| 7,021,103 | B2 | 4/2006 | Shore | |
| 7,093,472 | B1 * | 8/2006 | Shore et al. | 72/66 |
| 8,024,949 | B2 * | 9/2011 | Shore et al. | 72/66 |
| 8,256,257 | B2 * | 9/2012 | Shore et al. | 72/230 |

FOREIGN PATENT DOCUMENTS

| | | | |
|---|---|---|---|
| WO | 2007106110 | A1 | 9/2007 |
| WO | 2010056430 | A1 | 5/2010 |

OTHER PUBLICATIONS

PCT International Search Report mailed Jan. 22, 2013 corresponding to PCT International Application No. PCT/US2012/055960 filed Sep. 19, 2012 (10 pages).

* cited by examiner

*Primary Examiner* — Edward Tolan
*Assistant Examiner* — Mohammad I Yusuf

(57) ABSTRACT

A method is described in which a length of hot rolled product is decelerated in the course of being passed through the rotating curved guide of a coiler. The product exits the coiler at a reduced velocity and is delivered to and progressively accumulated on a cylindrical drum as a helical formation of rings. The drum is rotated to continuously unwind the accumulating product at the reduced velocity. The tail end of the product is retained in the coiler until substantially all of the rings previously deposited on the drum have been unwound.

4 Claims, 1 Drawing Sheet

TAIL END RING CONTROL IN A CURVED GUIDE OF A COILER

CROSS REFERENCE TO RELATED APPLICATIONS

This application claims benefit, under 35 U.S.C. §119 (e) of U.S. Provisional Application Ser. No. 61/539,689, filed Sep. 27, 2011, the entire content and substance of which is hereby incorporated by reference.

BACKGROUND

1. Field of the Invention

Embodiments of the present invention relate generally to rolling mills producing hot rolled bar and rod products, and more particularly to the operation of a so-called MORSHOR® system for decelerating and temporarily accumulating such products between successive rolling stages.

2. Description of Related Art

A MORSHOR® system for the deceleration and temporary accumulation of hot rolled bar and rod products is disclosed in U.S. Pat. No. 7,021,103, the description of which is herein fully incorporated by reference. In this system, a length of the hot rolled product is decelerated in the course of being passed through the rotating curved guide of a coiler. The product exits the coiler at a reduced velocity and is delivered to and progressively accumulated on a cylindrical drum as a helical formation of rings. The drum is rotated to continuously unwind the accumulating product at the reduced velocity. The orderly unwinding of the product from the rotating drum is dependent to a large extent on maintaining a stable ring formation.

But, experience has shown that after the tail end of the product exits the coiler, the last rings deposited on the drum become unstable, with erratically increased diameters caused by a combination of factors, including lost tension, centrifugal forces, and elastic deflection. The larger rings tend to overlap and cross over each other. This in turn can upset the unwinding process, resulting in a malfunction commonly referred to as a "cobble."

SUMMARY

Briefly described, aspects of the present invention are directed to retaining the tail end of the hot rolled product in the coiler until substantially all of the rings previously deposited on the drum have been unwound. In so doing, unstable ring formation is minimized.

BRIEF DESCRIPTION OF THE DRAWINGS

Aspects of the present invention will now be described in greater detail with reference to the accompanying drawings, wherein:

FIGS. 1A-4A are diagrammatic end views of the accumulator taken respectively at the operational stages shown in FIGS. 1-4 in accordance with the present invention.

DETAILED DESCRIPTION

Principles and features of the present invention are explained hereinafter with reference to implementation in illustrative embodiments. In particular, they are described in the context of a method of operating a MORSHOR® system for decelerating and temporarily accumulating hot rolled products in a rolling mill. Embodiments of the present invention, however, are not limited to use in the described systems.

The components described hereinafter as making up the various embodiments are intended to be illustrative and not restrictive. Many suitable components that would perform the same or a similar function as those described herein are intended to be embraced within the scope of embodiments of the present invention.

Figure 1:
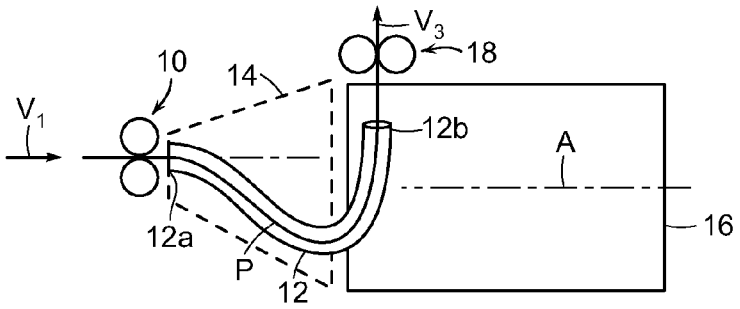
FIGS. 1-4 are diagrammatic elevational views depicting the operation of an accumulator at successive stages, in accordance with the present invention.
Figure 1A:
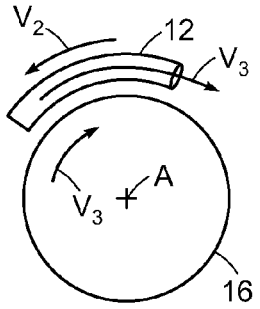

With reference initially to FIGS. 1 and 1A, an entry pinch roll unit 10 directs a product "P" moving longitudinally at a velocity $V_1$ along a receiving axis "A" into the curved guide 12 of a coiler 14. The curved guide 12 has an entry end 12*a* aligned on axis A to receive the product, and an exit end 12*b* spaced radially from axis A and oriented to deliver the product in an exit direction transverse to axis A.

At the operational stage shown in FIGS. 1 and 1A, the process of deceleration and accumulation begins. The curved guide 12 is rotating about axis A in a first direction opposite to the direction of the product exiting from the guide, and at a speed at which its exit end 12*b* has a velocity $V_2$ lower than $V_1$. This results in a deceleration of the exiting product to a reduced velocity $V_3$ equal to $V_1$-$V_2$.

Figure 2:
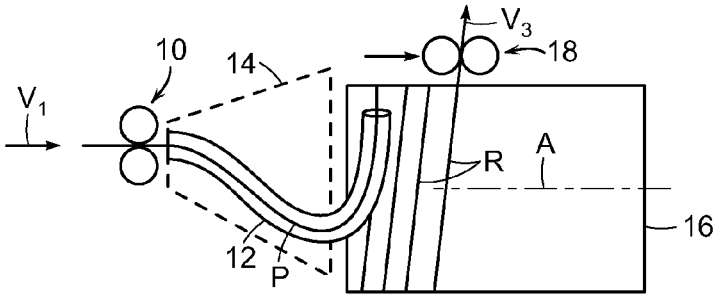

The curvature of the guide 12 and the orientation of its exit end 12*b* are such that as shown in FIG. 2, the exiting product is formed into a helix of interconnected rings "R". The rings are progressively accumulated on a cylindrical drum 16 rotating about axis A in a second direction opposite to the first direction of rotation of the guide 12, and at a surface velocity $V_3$, thereby allowing the product to unwind from the drum into an exit pinch roll unit 18 at velocity $V_3$.

Figure 2A:
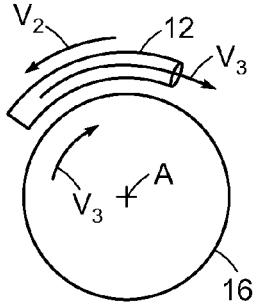

At the operational stage shown in FIGS. 2 and 2A, the exit pinch roll unit 18 is shown moving away from the coiler 14 as it follows the product unwinding from the accumulating helical formation of rings R on the drum 16. When the tail end of the billet approaches the entry pinch roll unit 10, the direction of movement of the exit pinch roll unit 18 is reversed, causing it to move back toward the coiler 14.

Figure 3:
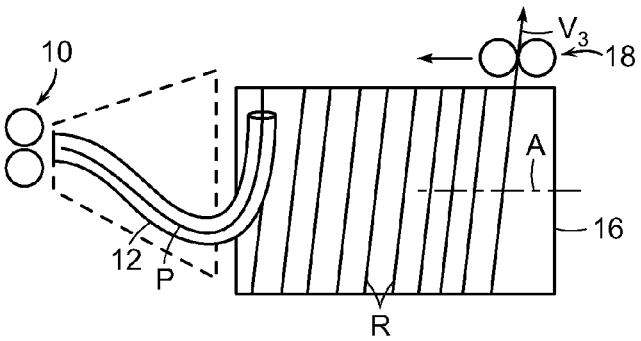
Figure 3A:
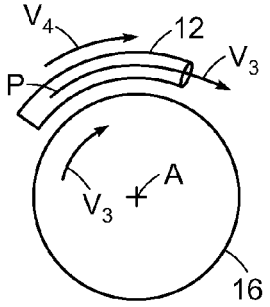

As shown in FIGS. 3 and 3A, when the tail end segment of the product clears the entry pinch roll unit 10, the direction of rotation of the guide 12 is reversed and rotated in the direction of rotation of the drum 16 and at a velocity $V_4$ which insures that the tail end segment remains retained in the guide 12 while the exit pinch roll unit 18 traverses back along the drum towards the coiler 14.

Figure 4:
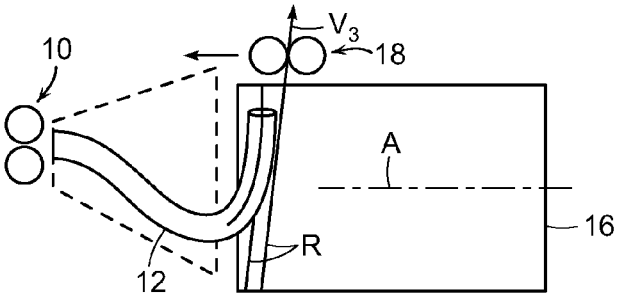
Figure 4A:
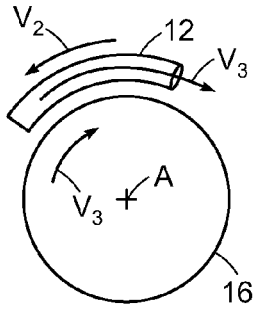

As shown in FIGS. 4 and 4A, when substantially all of the rings R have been unwound from the drum 16, the direction of rotation of the guide 12 is again reversed, resulting in the tail end segment of the product being pulled onto the drum. Preferably, this occurs when less than three rings remain on the drum.

While the product tail end segment remains captured within the curved guide 12, the last rings deposited are held under tension and are thus safeguarded from undergoing erratic expansion 16.

In light of the foregoing, stability of the rings R deposited on the drum 16 is enhanced by retaining the product tail end segment in the curved guide 12 of the coiler 14 until substantially all of the rings have been unwound. Preferably, the velocity $V_4$ of reverse rotation of the curved guide 12 is equal to the velocity $V_3$ of the drum 12. But, $V_4$ could be slightly lower than $V_3$, as long as the product tail end segment remains captured in the curved guide 12 during the time interval required to insure ring stability on the drum.

While embodiments of the present invention have been disclosed in exemplary forms, it will be apparent to those skilled in the art that many modifications, additions, and deletions can be made herein without departing from the spirit and scope of the invention and its equivalents, as set forth in the following claims.

The invention claimed is:

1. A method of decelerating and temporarily accumulating a length of a hot rolled product moving longitudinally along a receiving axis at a first velocity $V_1$, said method comprising:

directing said product through a curved guide having an entry end aligned with said axis to receive said product, and having an exit end spaced radially from said axis and oriented to deliver said product in an exit direction transverse to said axis;

rotating said curved guide about said axis in a first direction opposite to said exit direction and at a speed at which said exit end has a velocity $V_2$ lower than $V_1$, thereby decelerating the product being delivered from said exit end to a reduced velocity $V_3$, equal to $V_1-V_2$, the configuration of said curved guide and the orientation of said exit end being such as to form the product delivered from said exit end into a helical series of rings;

depositing and temporarily accumulating said rings on a cylindrical drum;

rotating said drum in a second direction opposite to said first direction and at a surface velocity allowing said rings to be unwound from said drum at velocity $V_3$; and retaining a tail end segment of said product in said curved guide by rotating said curved guide in the direction of rotation of said drum and at a velocity $V_4$ selected to achieve tail end retention for a time during which substantially all of said rings have been unwound from said drum.

2. The method of claim 1 wherein said tail end segment is retained in said curved guide until less than three rings remain on said drum.

3. The method of claim 1 wherein velocity $V_4$ is equal to velocity $V_3$.

4. The method of claim 1 wherein velocity $V_4$ is lower than $V_3$ but sufficient to insure retention of the tail end segment in said curved guide during said time.

* * * * *